US005727870A

United States Patent [19]

Grierson

[11] Patent Number: 5,727,870

[45] Date of Patent: Mar. 17, 1998

[54] INDIRECT ASYMMETRIC LUMINAIRE ASSEMBLY

[75] Inventor: Dean Grierson, British Columbia, Canada

[73] Assignee: Ledalite Architectural Products, Inc., Langley, Canada

[21] Appl. No.: 641,530

[22] Filed: May 1, 1996

[51] Int. Cl.[6] ..... F21S 3/02

[52] U.S. Cl. ..... 362/225; 362/241; 362/247

[58] Field of Search ..... 362/217, 225, 362/241, 247

[56] References Cited

U.S. PATENT DOCUMENTS

| | | | |
|---|---|---|---|
| 1,595,044 | 8/1926 | Cushing et al. | 362/247 |
| 2,147,959 | 2/1939 | Arbuckle | 362/225 |
| 2,284,194 | 5/1942 | Gangbin | 362/151 |
| 2,875,323 | 2/1959 | Harling | 362/225 |
| 2,914,657 | 5/1959 | Akely et al. | 362/247 |
| 3,375,361 | 3/1968 | Thompson et al. | 362/225 |
| 3,949,214 | 4/1976 | Jones et al. | 362/247 |
| 4,388,675 | 6/1983 | Lewin | 362/225 |
| 4,760,505 | 7/1988 | Cole, Jr. | 362/225 |
| 4,796,168 | 1/1989 | Peterson | 362/217 |
| 4,849,864 | 7/1989 | Forrest | 362/225 |
| 4,928,209 | 5/1990 | Rodin | 362/217 |
| 4,975,812 | 12/1990 | Cole, Jr. | 362/225 |
| 5,199,786 | 4/1993 | Baliozian | 362/297 |
| 5,272,607 | 12/1993 | Grimm | 362/219 |

FOREIGN PATENT DOCUMENTS

| | | | |
|---|---|---|---|
| 109070 | 11/1939 | Australia | 362/247 |
| 696251 | 10/1964 | Canada | 362/225 |

*Primary Examiner*—Alan Cariaso
*Attorney, Agent, or Firm*—Stoel Rives LLP

[57] ABSTRACT

An assembly and method utilizing a staggered multiple lamp and reflector configuration for indirect illumination providing superior photometric distribution and light utilization, which is adaptable to a slim profile design. The lamps are staggered and surrounded by reflectors which separate the light emanating from the lamps and thereby minimize absorption of light directed from one lamp to the adjacent lamp. Light is directly or, when it strikes reflectors surrounding the respective lamps, indirectly directed to an extended reflector which directs light to the illuminated surface.

14 Claims, 7 Drawing Sheets

INDIRECT ASYMMETRIC LUMINAIRE ASSEMBLY

TECHNICAL FIELD

The present invention relates generally to multiple-lamp luminaire assemblies for indirect illumination of a horizontal or vertical surface. It particularly relates to indirect asymmetric luminaire assemblies with two or more linear lamps that are staggered in lateral and vertical directions, and a reflector design that separates and redirects light propagated from the lamps to evenly illuminate an adjacent ceiling or wall. The invention maximizes the utilization of light from the luminaire and improves the photometric distribution of the optical system in a configuration that is adaptable to a slim profile design.

BACKGROUND OF THE INVENTION

Indirect luminaires are designed to distribute light upwards to directly and evenly illuminate the ceiling of a room, where the luminaires are suspended some distance from the ceiling. The light reflected from the ceiling then indirectly illuminates the walls and floor of the room, and objects and furniture within the room. This indirect illumination minimizes the possibility of visual glare and veiling reflections from glossy surfaces.

As shown in FIG. 1, the optical systems of conventional indirect luminaires are typically designed such that the photometric distribution of light is symmetric about the longitudinal axis of the luminaire 8, and to ensure that the resultant distribution of direct illuminance, i.e., light, at the ceiling is as uniform as possible when the luminaires are evenly spaced in a horizontal plane below the ceiling. To the human observer, the ceiling then appears to have an approximately uniform luminance, or photometric brightness, distribution.

Now referring to FIG. 2, where the indirect luminaires are situated against or adjacent to a wall, a conventional indirect asymmetric luminaire 10 such as shown in FIG. 2 is employed to evenly illuminate the ceiling without directly illuminating the adjacent wall. Indirect asymmetric luminaires are therefore designed such that their photometric distribution is asymmetric about the longitudinal axis of the luminaire 10. That is, rather than being symmetrically dispersed around the luminaire, the light is asymmetrically directed away from the adjacent wall and toward the ceiling. The optical systems of these luminaires are designed such that the distribution of direct illuminance at the ceiling complements the symmetric photometric distribution of adjacent indirect luminaires, and which in combination produce an approximately uniform ceiling luminance distribution.

A closely related class of indirect asymmetric luminaires is commonly referred to in the lighting industry as "wall-washer" luminaires. These luminaires are mounted directly on or immediately adjacent to a wall, and are designed to provide an evenly distributed "wash" of light on the wall surface.

In addition to providing a suitable photometric distribution, it is desirable for an indirect asymmetric luminaire to efficiently utilize the light emitted by its lamps. A luminaire's "efficiency" is a measure of the percentage of light emitted by the lamps that escapes the luminaire. Maximizing the efficiency of a luminaire thus entails directing as much of the emitted light as possible towards the ceiling in accordance with by the desired photometric distribution and minimizing the amount of light absorbed the internal components of the luminaire.

The design of the luminaire housing is often subject to aesthetic and architectural considerations. In particular, it is usually desirable for an indirect luminaire, when viewed in cross-section, to have a visually unobtrusive (that is, slim) vertical profile. This often places severe restrictions on the design options for the luminaire reflectors and lamp mountings.

Indirect asymmetric and wall-washer luminaires are usually designed to essentially eliminate "stray light" emitted from the luminaire in a direction that is parallel to or below the horizontal plane of the luminaire. In keeping with the objective of indirect lighting, this requirement minimizes the possibility of visual glare and veiling reflections from glossy surfaces of objects or furniture within the room. It also places further restrictions on the design options for the luminaire reflectors and lamp mountings.

In the past, them have existed no indirect asymmetric or wall-washer luminaires, that combine an optimal photometric distribution and satisfactory luminaire efficiency with an acceptably slim luminaire profile and no stray light. Prior art luminaire assemblies have employed lamp mounting and reflector designs that generally attempt to provide a satisfactory photometric distribution in a luminaire housing with a slim profile at the expense of luminaire efficiency. This is due largely to the close proximity of the lamps required to provide such compact configurations; much of the light from the lamps in conventional multiple-lamp assemblies is intercepted by the adjacent lamp or lamps, or is otherwise reflected from inner surfaces of the housing in undesirable directions, thereby degrading the photometric distribution.

A typical example of a prior art, indirect asymmetric design luminaires is illustrated in FIGS. 3 to 5. As shown, prior art luminaire assembly 10 includes linear lamps 12 and 14 that are vertically stacked and aligned along their respective longitudinal axes. Luminaire assembly 10 also employs reflectors 16, 18 and 20 which surround the back and sides of lamps 12 and 14. Depending on the required photometric distribution, these reflectors may have specular, semi-specular, or matte-finishes. Relevant examples of such finishes are polished aluminum, glossy white enamel paint or brushed aluminum, and matte white paint.

Referring to FIG. 5, the dotted and arrowed lines (hereinafter referred to as "rays" of light) illustrate some of the possible directions of light propagating from lamps 12 and 14. As indicated by these rays, some of the light emitted by lamps 12 and 14 propagates directly away from the luminaire in the desired directions. Other rays may intercept and be reflected by one or more of the reflectors 16, 18, 20 and 22 before leaving the luminaire. Still other rays emitted by lamps 12 and 14 are intercepted and are mostly absorbed by the adjacent lamp. These intercepted rays do not leave the luminaire. Thus, the efficiency of the luminaire is reduced.

The primary purpose of reflectors 16 and 18 is to redirect the light emitted by lamps 12 and 14 towards reflectors 20 and 22. The purpose of reflectors 20 and 22 is to redirect the light emitted by lamps 12 and 14 towards the target ceiling or wall. The precise dimensions of these reflectors, the vertical spacing between lamps 12 and 14, and the reflector surface finishes are all chosen to achieve the desired photometric distribution of light from the luminaire.

One major problem of the prior art illustrated in FIGS. 3 to 5 is evident in FIG. 5, where it can be seen that a substantial portion of the light emitted by lamp 12 is directed toward lamp 14 and, conversely, from lamp 14 toward lamp 12. Much of this light is absorbed by the intercepting lamps, which decreases the luminaire efficiency.

A second major problem of the prior art is that the dimensions and positions of reflectors 20 and 22 are invariably a design compromise. Ideally, reflectors 20 and 22 would assume different dimensions and positions in order to optimally redirect the light from each lamp to the ceiling or wall to obtain the desired photometric distribution. However, because the light emitted by the two lamps cannot be separated, a compromise reflector design is required.

Until now, there has been no indirect asymmetric or wall-washer luminaire assembly which provides satisfactory photometric distribution, and which maximizes utilization of light by the optical systems, while being adaptable to a slim profile design. While prior art designs have offered reasonable photometric distributions, their luminaire efficiencies have been low, typically ranging from 40 to 60 percent. Therefore, the need for an indirect asymmetric luminaire system which offers better photometric distributions and improved luminaire efficiency persists.

SUMMARY OF THE INVENTION

Addressing such and other problems with the prior art, the present invention is drawn toward an assembly and a method utilizing a multiple lamp and reflector configuration for indirect illumination that provides superior photometric distribution and light utilization, and which is adaptable to a slim profile design. The indirect asymmetric luminaire assembly of this invention includes an elongated outer housing, and at least two electrical sockets supported within the housing, the electrical sockets being positioned to stagger the lamps mounted therein. Each of the lamps associated with a proximate side optical reflector for partly surrounding longitudinal surfaces of the lamps and an optical reflector arm extending outwardly from the lower surface of the optical reflector at an angle that directs the lower light outwardly from the lamps and toward the target area to provide a predetermined photometric distribution. The side optical reflectors have an inclined upper surface and a lower surface oriented at an angle more proximate to the horizontal than the upper surface and a side surface extending between the upper and lower surfaces of the optical reflectors. The side optical reflectors are configured to direct light toward a target area such that minimal light is directed from one lamp to another lamp of the luminaire assembly. This separates, and thus minimizes absorption of, light emitted by each lamp.

The optical reflectors of this luminaire assembly may be configured from elongate rectangular plates composed of a suitable material. This is accomplished by bending or otherwise forming the reflector material to an appropriate profile along the longitudinal axis of the plate. The reflective surface of each plate is provided with a specular, glossy, or matte finish, as determined by the desired photometric distribution for the optical system.

The lamp and reflector configuration employed by the present method and device optimizes utilization of light emitted by the lamps, and thereby maximizes the luminaire efficiency. This invention also provides a configuration that eliminates stray light directed at or below a horizontal plane that intersects the luminaire assembly.

DETAILED DESCRIPTION OF THE INVENTION

Figure 1:
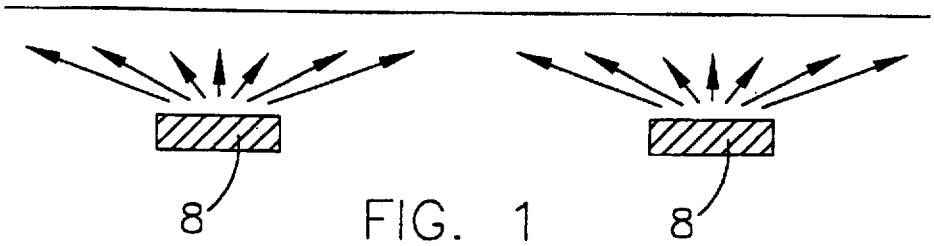
FIG. 1 PRIOR ART
FIG. 1 is a simplified diagram illustrating the installation of suspended indirect luminaires in a room, with rays of light whose length denotes the approximate photometric distribution of the luminaires and consequent direct illumination of the ceiling.
Figure 2:
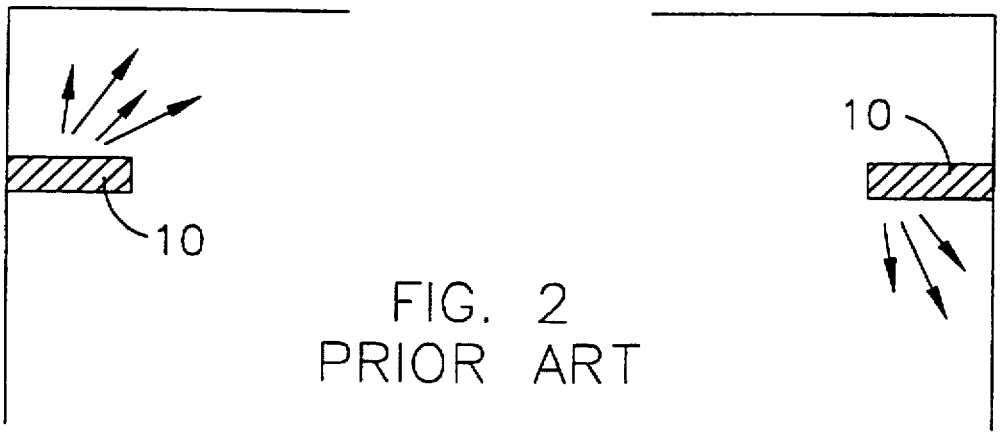
FIG. 2 PRIOR ART
FIG. 2 is a simplified diagram illustrating the installation of wall-mounted, indirect asymmetric and wall-washer luminaires in a room, with rays of light denoting the approximate photometric distribution of the luminaires and consequent direct illumination of the ceiling and wall respectively.
Figure 3:
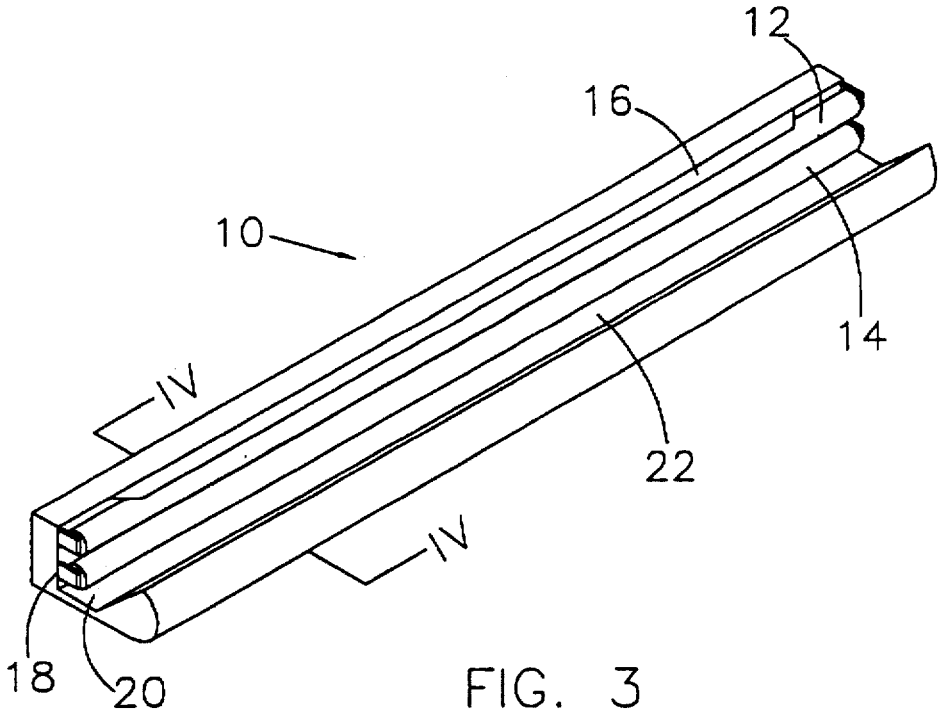
FIG. 3 PRIOR ART
FIG. 3 is a simplified isometric drawing illustrating a side perspective view of a conventional indirect asymmetric luminaire assembly.
Figure 4:
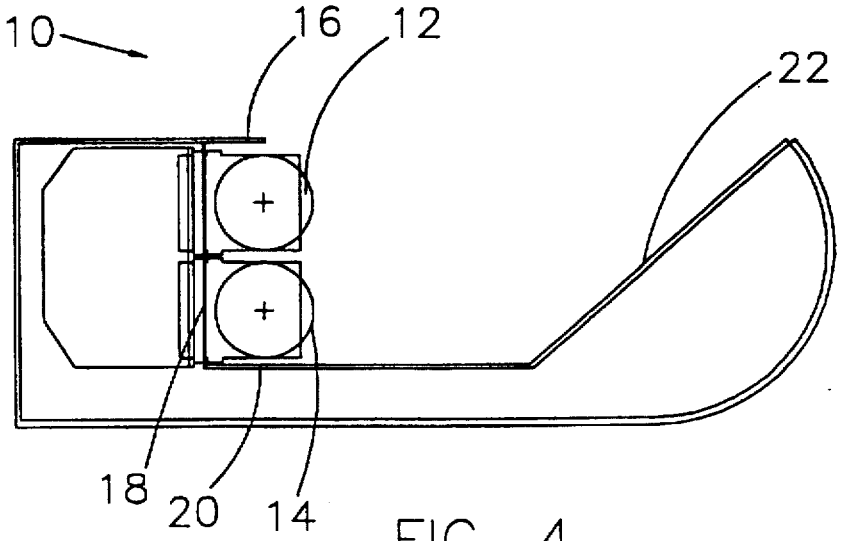
FIG. 4 PRIOR ART
FIG. 4 is a simplified diagram illustrating a cross-section view taken along lines IV—IV of FIG. 3 showing a conventional indirect asymmetric luminaire assembly.
Figure 5:
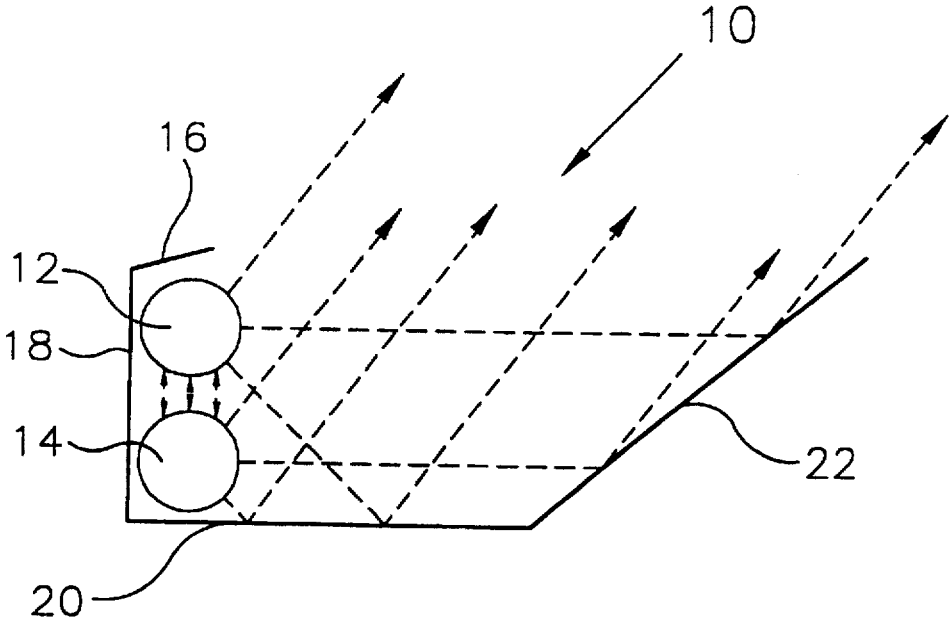
FIG. 5 PRIOR ART
FIG. 5 is a schematic illustration of the direction of representative light rays propagated from a conventional luminaire.

Referring to FIGS. 6 to 9, luminaire assembly 30 includes a generally elongated rectangular outer housing 32 and a vertical sidewall 36 that is fastened using appropriate connectors to a wall adjacent to a ceiling.

To housing 32 is attached an optical assembly that includes two electrical lamp sockets 42 and 44 which are supported and affixed within outer housing 32. Linear lamps 46 and 48 are mounted in lamp sockets 42 and 44. In the embodiment shown, lamps 46 and 48 are fluorescent bulbs which typically measure about four feet in length. Alternatively, any elongate bulb, such as, for example, neon tubing, may be employed. The electrical connections to lamps 46 and 48 and their manner of operation is standard and has not been shown in FIG. 7, because such aspects of the luminaire assembly will be readily apparent to persons skilled in the art.

Figure 6:
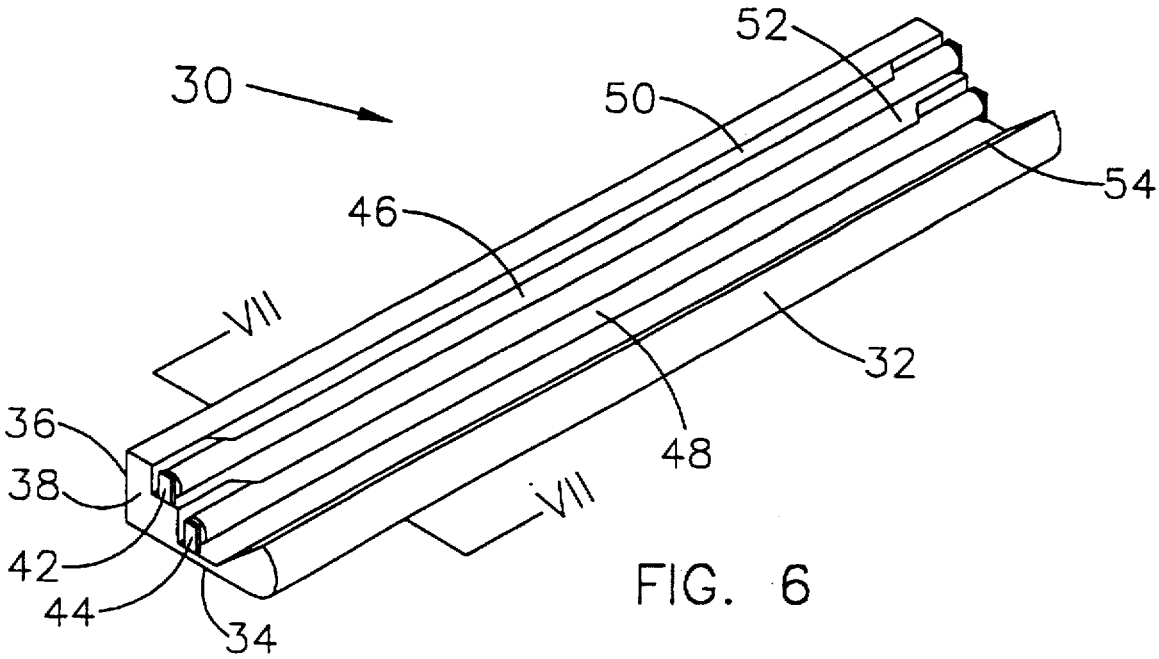
FIG. 6 is a simplified isometric drawing illustrating a side perspective view of a preferred embodiment of the indirect asymmetric luminaire assembly according to the present invention when mounted on a wall.
Figure 7:
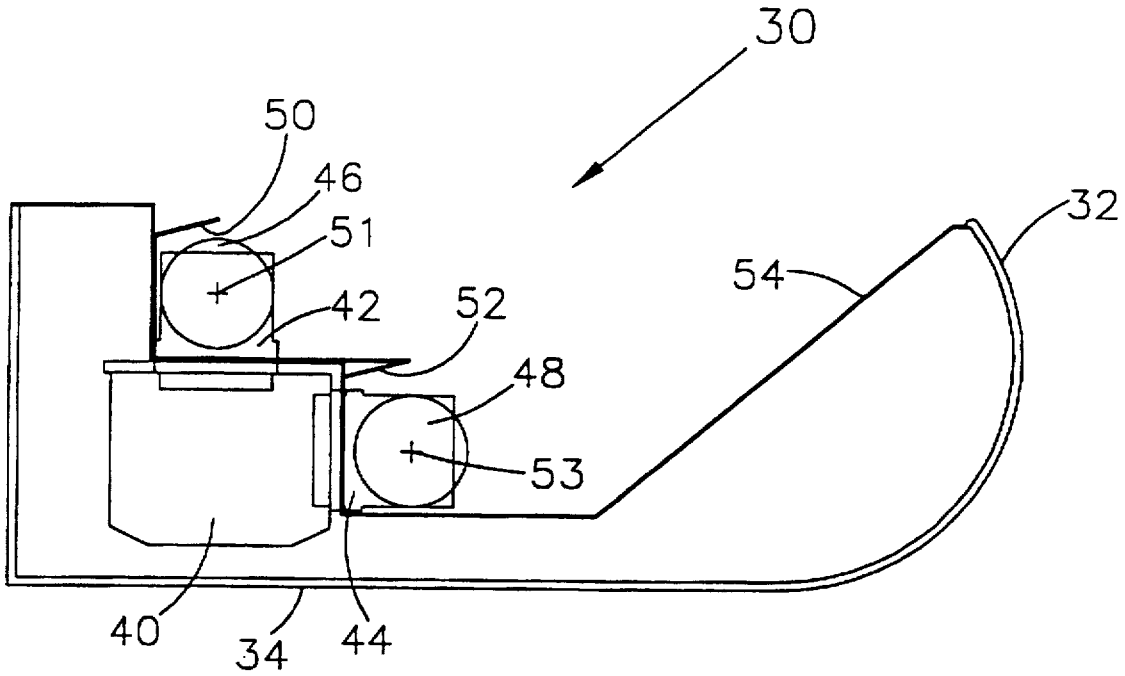
FIG. 7 is a simplified diagram illustrating a cross-section view taken along lines VII—VII of FIG. 6 showing the indirect asymmetric luminaire assembly according to the present invention.

When mounted in electrical sockets 42 and 44, lamps 46 and 48 are staggered along their longitudinal axes. As used herein, the term "stagger" means any orientation wherein the radial centers of lamps in a luminaire assembly are not aligned along their longitudinal axes in either a side-by-side, horizontal, or a stacked, vertical direction. As is most clearly shown in the cross-section view illustrated in FIG. 7, in the preferred embodiment depicted in the drawings, there is no overlap of the outermost opposing surfaces of lamps 46 and 48. In alternative embodiments of the present invention, the gap or extent of staggering between or separation of planes parallel to the longitudinal planes disposed at the horizontal and vertical planes of the lamps may vary. Thus, the outer surface of each of lamps 46 and 48 defines a projection having an area. As best seen in FIGS. 6 and 7, the staggering of lamps 46 and 48 is such that their longitudinal aces overlap in a plane but are offset in the horizontal and vertical directions so that the projection areas of the outer surfaces of lamps 46 and 48 are partly or totally nonoverlapping.

Luminaire assembly 30 further includes reflectors 50 and 52, and reflector arm 54. These reflectors are preferably comprised of substantially planar surfaces that extend the entire length of housing of lamps 46 and 48. Reflectors 50 and 52, and reflector arm 54, can be formed by bending one or more flat elongate plates along straight lines parallel to their longitudinal axes at locations and angles shown in FIGS. 7, 8, and 9 to form substantially planar surfaces angled to optimize separation of light propagating from lamps 46 and 48 and to maximize the amount of light ultimately directed to he ceiling or the wall. In alternative embodiments of the present invention, said reflectors may be curved rather than planar surfaces, the profile of such curves being determined by the desired photometric distribution of the luminaire.

As described in detail below, the reflector plate is shaped to form two substantially bracket-shaped reflectors 50 and 52, and an elongated reflector arm 54. Reflecting light toward reflectors 50 and 52, and reflector arm 54, is largely accomplished by choosing specular, or highly polished, materials for the elongate plates to obtain maximum reflection of all light that strikes the reflective surfaces of the reflectors. In alternative embodiments of the present invention, reflectors 50, 52 or 54 may be finished or otherwise coated with appropriate materials to present semispecular or diffusely-reflective inner surfaces.

Surrounding the back and sides of each of lamps 46 and 48 are reflectors 50 and 52, which are similar in profile, and which include top, side and bottom substantially planar surfaces. The top surfaces of reflectors 50 and 52 are slightly inclined at an upward angle and extend approximately to the radial centers 51 and 53 of lamps 46 and 48, respectively. The lower surfaces of reflectors 50 and 52 extend outwardly from the vertical sides in a horizontal direction substantially perpendicular to vertical wall 36 and beyond the circumferences of the respective lamps they underlie. The lower surface of reflector 50 extends above lamp 48. The lower surface of reflector 50 extends to the radial center 53 of lamp 48 and bent back toward the side surface to form an angle that provides the slight upward incline of the upper surface of reflector 52. As previously described, the angles and dimensions of the side and lower surfaces of reflector 52 are substantially the same as the corresponding surfaces of reflector 50. The reflector plane extending from the lower surface of reflector 52 extends into reflector arm 54, which is oriented at an upward incline from the horizontal plane of the lower surface of reflector 50 when mounted. As will be apparent to persons skilled in the art, the angle of this incline is determined by the desired photometric distribution of the luminaire.

Figure 8:
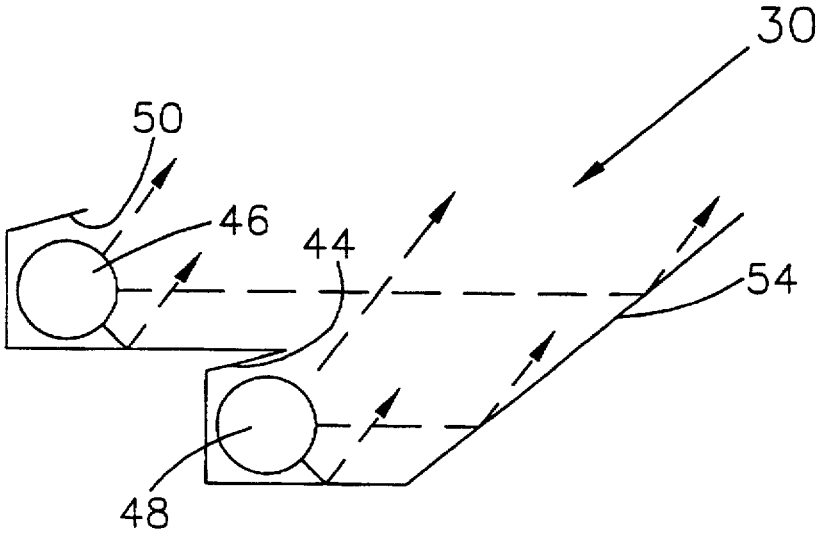
FIG. 8 is a schematic illustration of the direction of representative light rays propagated from the indirect asymmetric luminaire according to the present invention, with the intended purpose of evenly illuminating an adjacent ceiling.
Figure 9:
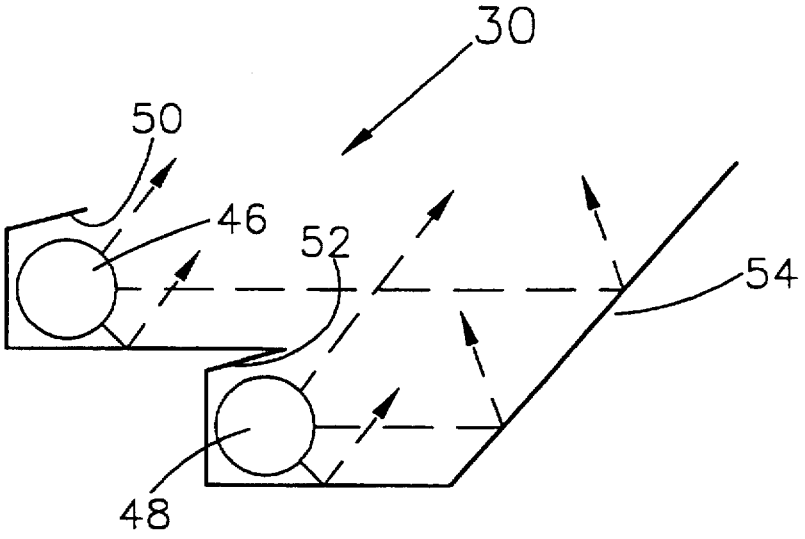
FIG. 9 is a schematic illustration of the direction of representative light rays propagated from the indirect asymmetric luminaire according to the present invention, with the intended purpose of evenly illuminating an adjacent wall.

Now referring to FIGS. 8 and 9, the dotted and arrowed lines depict the direction of the representative light rays propagating through and out of the optical system, and reflectors 50 and 52 isolate and separate light propagating from lamps 46 and 48, respectively, in the following manner. Light emanating from lamp 46 extending toward lamp 48 strikes the reflective surface of reflector 50 lying between the two lamps which reflects it upward and outward past lamp 48 and toward reflector arm 54. Similarly, light extending in a comparable direction from lamp 48 strikes the reflective surface of reflector arm 54 lying between the two lamps and is deflected away from lamp 46 and toward reflector arm 54. Thus, absorption of light emanating from either lamp 46 and 48 of luminaire assembly 30 by the other lamp is minimized. Overall light utilization or output is thereby maximized.

In a preferred embodiment of the present invention, the reflective surfaces of reflectors 50 and 52 are coated with a specular material, and a glossy white enamel finish is applied to the surface of reflector arm 54. This glossy white finish on the reflective surface of reflector arm 54 improves the photometric distribution of the luminaire for the intended purpose of evenly illuminating target ceiling or wall for FIGS. 8 and 9 respectively.

Light emanating from lamps 46 and 48 is directed, either directly or indirectly, by reflection of light from lamp 46 by reflector 50, and light emanating from lamp 48 by reflector 52, to reflector arm 54. Reflector arm 54 is angled to ultimately redirect the light striking its surface toward the target ceiling or wall. In the particular embodiment illustrated, the optical efficiency, i.e., proportion of light propagated by lamps 46 and 48 that is utilized by the optical system of luminaire assembly 30 measures about 73 percent.

Figure 10:
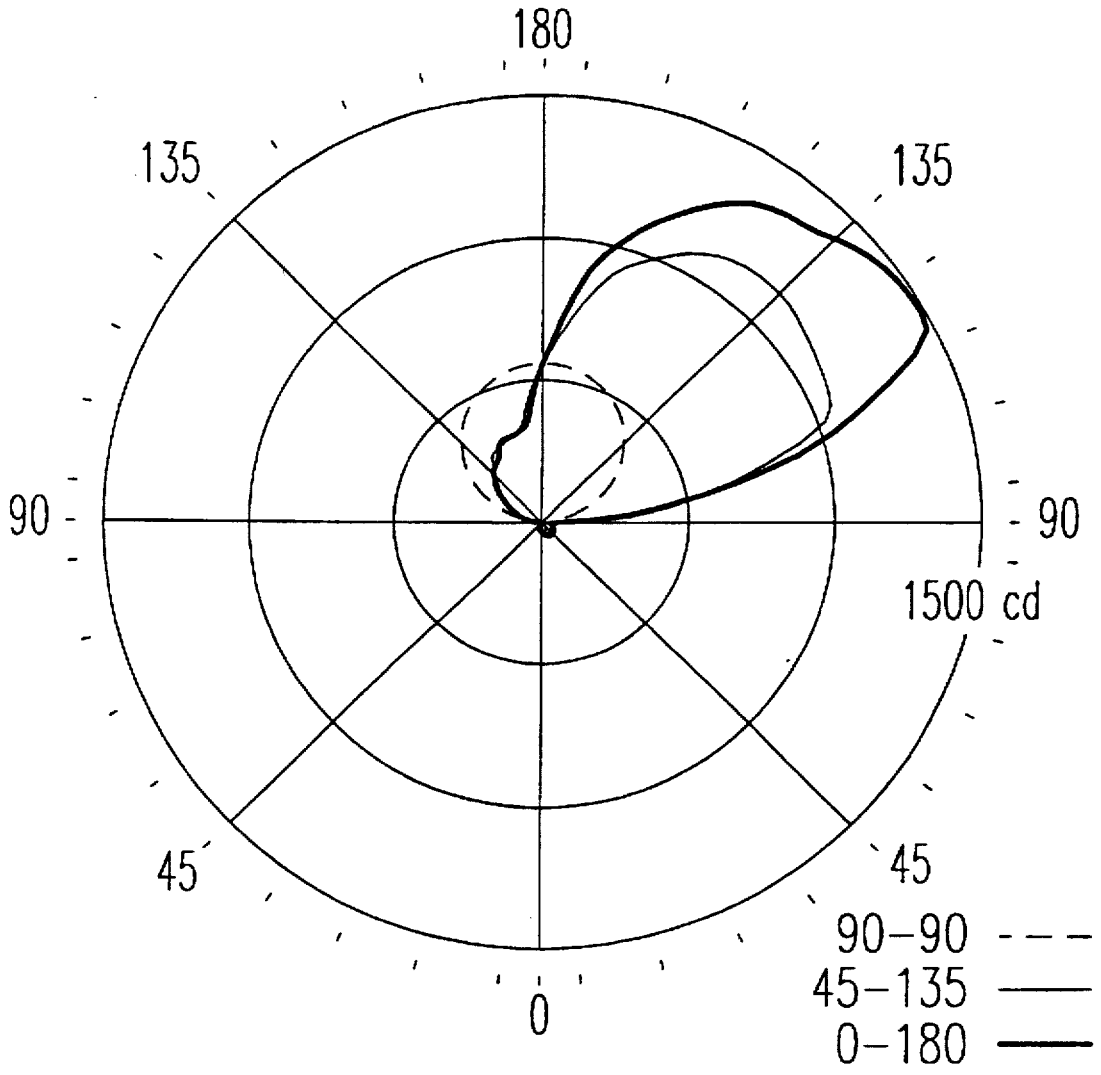
FIG. 10 is a graph depicting the photometric distribution of a prior art indirect asymmetric luminaire.

The data provided below is graphically depicted in FIGS. 10 and 11. It demonstrates that, as compared to prior art designs, the lamp and reflector configuration of the present invention provides superior light utilization. FIG. 10 depicts a polar plot of the candela, i.e., "luminous intensity," distribution of a typical prior art indirect asymmetric luminaire. The polar plot illustrates luminous intensity at the angles marked on the graph. Corresponding numeric candela values shown in the graph are set forth in the table below:

| | CANDELA DISTRIBUTION | | | | | FLUX |
|---|---|---|---|---|---|---|
| | 0 | 45 | 90 | 135 | 180 | Lumens |
| 0 | 33 | 33 | 37 | 33 | 35 | |
| 5 | 37 | 335 | 36 | 32 | 32 | 3 |
| 15 | 44 | 39 | 34 | 25 | 22 | 10 |
| 25 | 50 | 43 | 30 | 17 | 12 | 15 |
| 35 | 54 | 44 | 26 | 8 | 4 | 16 |
| 45 | 54 | 39 | 20 | 3 | 0 | 16 |
| 45 | 54 | 39 | 20 | 3 | 0 | 16 |
| 55 | 50 | 37 | 13 | 0 | 0 | 16 |
| 65 | 46 | 31 | 6 | 0 | 0 | 16 |
| 75 | 38 | 26 | 2 | 0 | 0 | 12 |
| 85 | 37 | 23 | 0 | 0 | 4 | 11 |
| 90 | 35 | 19 | 0 | 2 | 2 | |
| 95 | 297 | 254 | 22 | 21 | 19 | 135 |
| 105 | 900 | 791 | 111 | 72 | 68 | 390 |
| 115 | 1400 | 1077 | 218 | 135 | 124 | 545 |
| 125 | 1478 | 1108 | 312 | 196 | 181 | 558 |
| 135 | 1409 | 1139 | 390 | 234 | 236 | 506 |
| 145 | 1349 | 1122 | 457 | 294 | 266 | 422 |
| 155 | 1214 | 1035 | 505 | 308 | 319 | 303 |
| 165 | 1018 | 902 | 540 | 333 | 325 | 173 |
| 175 | 709 | 661 | 558 | 469 | 432 | 55 |
| 180 | 561 | 561 | 561 | 561 | 561 | |

The numeric values demonstrating the optical efficiency of the prior art luminaire assembly shown in the graph of FIG. 10 and corresponding candela distribution values in the above table are summarized in the following zonal lumen summary chart:

ZONAL LUMEN SUMMARY

| Zone | Lumens | % Fixture | % Lamp |
|---|---|---|---|
| 0–30 | 27 | 0.8% | 0.5% |
| 0–40 | 43 | 1.3% | 0.7% |
| 0–60 | 75 | 2.3% | 1.3% |
| 0–90 | 113 | 3.5% | 1.9% |
| 90–130 | 1627 | 50.9% | 28.0% |
| 90–150 | 2554 | 79.9% | 44.0% |
| 90–180 | 3084 | 96.5% | 53.2% |
| 0–180 | 31997 | 100.0% | 55.1% |

Figure 11:
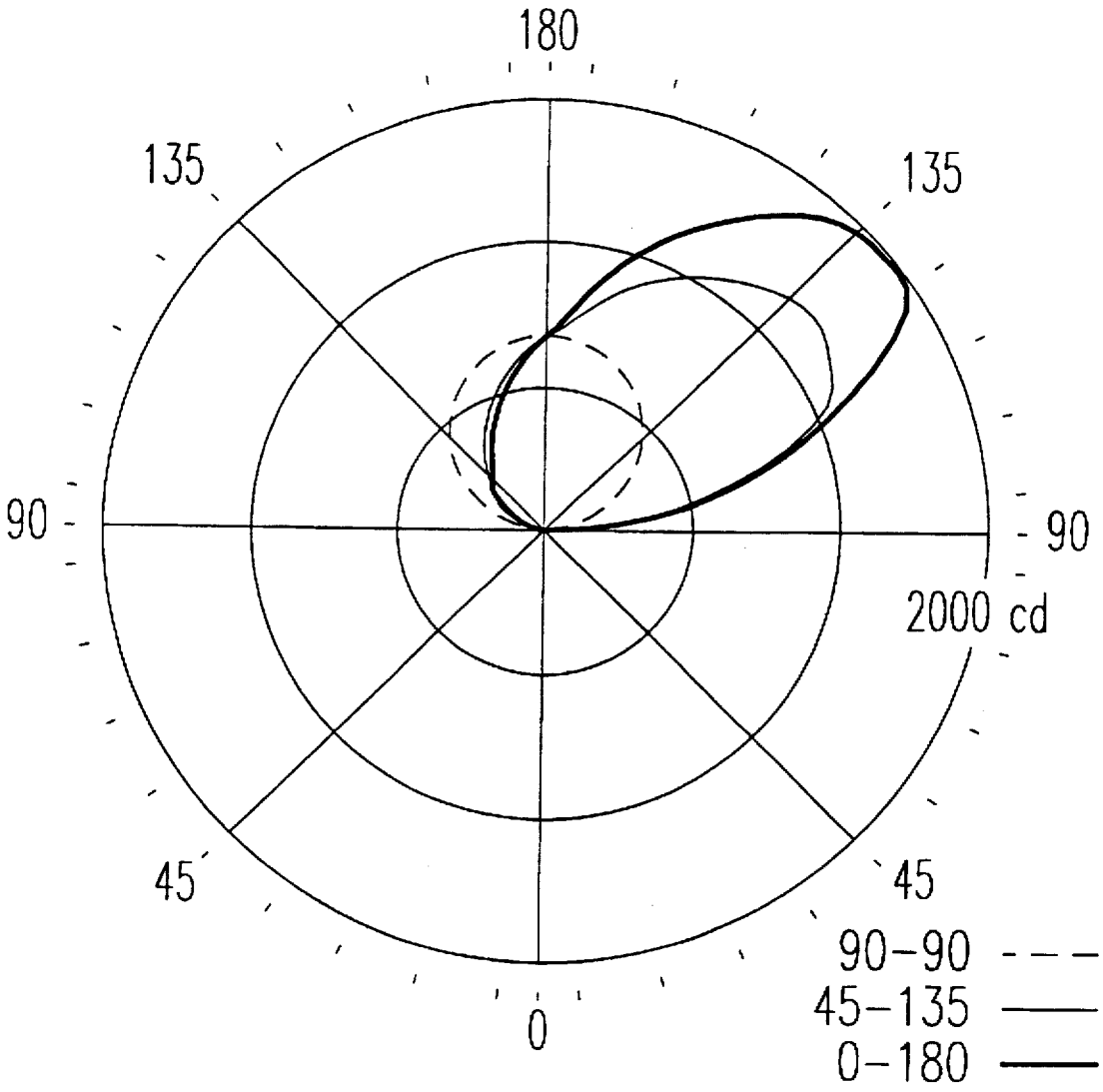
FIG. 11 is a graph depicting the photometric distribution of a preferred embodiment of the present invention.

FIG. 11 is a graphic depiction of the candela distribution of the indirect luminaire assembly of present invention illustrated in the drawings. The numeric values corresponding to the polar plot follow:

| | CANDELA DISTRIBUTION | | | | | FLUX |
|---|---|---|---|---|---|---|
| | 0 | 45 | 90 | 135 | 180 | Lumens |
| 0 | 0 | 0 | 0 | 0 | 0 | |
| 5 | 0 | 0 | 0 | 0 | 0 | 0 |
| 15 | 0 | 0 | 0 | 0 | 0 | 0 |
| 25 | 0 | 0 | 0 | 0 | 0 | 0 |
| 35 | 0 | 0 | 0 | 0 | 0 | 0 |
| 45 | 0 | 0 | 0 | 0 | 0 | 0 |
| 55 | 0 | 0 | 0 | 0 | 0 | 0 |
| 65 | 0 | 0 | 0 | 0 | 0 | 0 |
| 75 | 0 | 0 | 0 | 0 | 0 | 0 |
| 85 | 0 | 0 | 0 | 0 | 0 | 0 |
| 90 | 0 | 0 | 0 | 0 | 0 | 0 |
| 95 | 324 | 300 | 39 | 11 | 5 | 176 |
| 105 | 935 | 877 | 179 | 84 | 66 | 477 |
| 115 | 1510 | 1394 | 330 | 193 | 151 | 700 |
| 125 | 1973 | 1534 | 479 | 273 | 267 | 774 |
| 135 | 1961 | 1532 | 612 | 365 | 333 | 713 |
| 145 | 1792 | 1423 | 725 | 484 | 425 | 591 |
| 155 | 15411 | 1290 | 809 | 612 | 552 | 435 |
| 165 | 1270 | 1126 | 870 | 739 | 693 | 264 |
| 175 | 994 | 954 | 902 | 857 | 837 | 89 |
| 180 | 904 | 904 | 904 | 904 | 904 | |

The zonal lumen summary for the preferred embodiment of the present invention corresponding to the graph shown in FIG. 11 follows:

ZONAL LUMEN SUMMARY

| Zone | Lumens | % Fixture | % Lamp |
|---|---|---|---|
| 0–30 | 0 | 0.0% | 0.0% |
| 0–40 | 0 | 0.0% | 0.0% |
| 0–60 | 0 | 0.0% | 0.0% |
| 0–90 | 0 | 0.0% | 0.0% |
| 90–130 | 2126 | 50.4% | 36.6% |
| 90–150 | 3430 | 81.3% | 59.1% |
| 90–180 | 4217 | 100.0% | 72.7% |
| 0–180 | 4217 | 100.0% | 72.7% |

This data shows the superior photometric distribution and light utilization of the present indirect asymmetric luminaire invention over the prior art. The light propagating from the luminaire according to the present invention is more focused in the optimal zone of between about 125 and 145 degrees. These values for luminous intensity are 1792 to 1973 candela, and are substantially greater than the values—349 to 1478 candela—for the prior art luminaire design. In alternative embodiments of the present invention, such as the wall-washer design illustrated in FIG. 9, the optimal zone for maximum candela distribution may be different.

As shown by the zonal lumen summary charts, another advantage provided by this invention is the elimination of stray light directed at or below the horizontal or 0–90 degree plane, e.g., toward the floor. In comparison, almost 2% of the light emanating from the prior art luminaire is stray light, causing undesirable direct illumination. Therefore, the present invention provides the improvements of alleviating glare associated with the prior art.

The data also shows that the present invention provides light utilization resulting in about 18 percent greater optical efficiency than the prior art. The prior art utilizes only 55.1% of the light emitted by the luminaire lamps. In contrast, 72.7% light utilization is provided by the embodiment of the present invention illustrated herein. The proportion of light utilized, i.e., optical efficiency of the present luminaire thus shown to be greatly improved over the prior art.

The data demonstrates the improved light utilization of the luminaire according to the present invention associated with minimizing absorption of light by an adjacent lamp, focusing light in the optimal zone of illumination, and eliminating stray light. Thus, the advantages of improved photometric distribution and optical efficiency, provided by this compact lamp and reflector configuration, which is adaptable to a slim profile, required by indirect luminaire assemblies, can be seen.

It will be obvious to those having skill in the art that various changes may be made in the details of the present invention without departing from the underlying principles. Such skilled persons will recognize that alternative embodiments which may include, for example, configurations, materials, and mountings on various surfaces to provide indirect illumination of surfaces other than ceilings may be employed in an indirect asymmetric luminaire according to the present invention. For example, the relative positions of lamps within the scope of this invention include any such staggered formation having the reflector configuration described and claimed herein. Artisans will also appreciate that the present invention may employ configurations suitable for mounting on the floor or wall to illuminate an adjacent wall. The scope of the present invention should, therefore, be determined only by the following claims.

I claim:

1. An indirect asymmetric luminaire assembly for maximizing utilization of light propagating therefrom, comprising:

an elongate outer housing;

multiple electrical sockets supported the outer housing to receive linear lamps having longitudinal axes and outer surfaces, each of the outer surfaces defined by a projection having an area, the electrical sockets being positioned to arrange the linear lamps so that the longitudinal axes overlap in a plane but are offset in first and second orthogonal directions so that the projection areas of the outer surfaces are at least partly nonoverlapping;

multiple elongated side optical reflectors supported within the outer housing, each of the optical reflectors having a side surface intersecting in a transverse direction an inclined first surface and a second surface, the second surface oriented at an angle of lesser degree than that of the inclined first surface relative to a reference plane, and the side surface extending between the first and second surfaces of the optical reflectors, the optical reflectors being configured to direct light emitted by the linear lamps toward a target area and away from the linear lamps of the luminaire assembly; and an optical reflector arm operatively associated with one of the multiple side optical reflectors to receive light from the linear lamps, the optical reflector arm extending outwardly at an angle from the lower surface of the one of the optical reflectors to direct the light outwardly from the linear lamps and toward the target area to provide a predetermined photometric distribution.

2. The indirect luminaire assembly of claim 1, wherein the optical reflectors are configured from a flat elongate rectangular plate.

3. The indirect luminaire assembly of claim 1, wherein the optical reflectors are configured from a flat rectangular plate having a reflective surface comprising a specular material.

4. The indirect luminaire assembly of claim 1, wherein the optical reflectors have reflective surfaces comprising a specular material, and wherein the reflector arm has a reflective surface comprising a glossy white finish.

5. The indirect luminaire assembly of claim 1, wherein the electrical sockets are positioned such that the projection areas of the linear lamps received by the electrical sockets are completely nonoverlapping.

6. The indirect luminaire assembly of claim 1, wherein the linear lamps comprise fluorescent lamps.

7. The indirect luminaire assembly of claim 1, wherein the optical reflectors are configured to eliminate stray light directed at or below a plane under the second surface of the optical reflector to which the optical reflector arm is attached.

8. A method for maximizing utilization of light propagating from an indirect asymmetric luminaire assembly toward a target area, comprising:

providing an elongate outer housing;

mounting to the outer housing multiple electrical sockets to receive linear lamps having longitudinal axes and outer surfaces, each of the outer surfaces defined by a projection having an area, the electrical sockets being positioned to arrange the linear lamps so that the longitudinal axes overlap in a plane but are offset in first and second orthogonal directions so that the projection areas of the outer surfaces are at least partly nonoverlapping;

directing light propagating from the multiple linear lamps to prevent light absorption by mutually adjacent ones of the linear lamps of the luminaire assembly; and directing light propagating from the linear lamps toward a reflective surface configured to direct the light toward the target area.

9. The method of claim 8, wherein the linear lamps comprise fluorescent lamps.

10. The method of claim 8, wherein the directing of light to prevent light absorption is accomplished by side optical reflectors associated with the linear lamps and the directing of light toward the target area is accomplished by a reflector arm extending from one of the optical reflectors, the optical reflectors and reflector arm configured from a flat rectangular plate having a reflective surface comprising specular material.

11. The method of claim 8, wherein the directing of light to prevent light absorption is accomplished by side optical reflectors associated with the linear lamps and the directing of light toward the target area is accomplished by a reflector arm extending from one of the optical reflectors, the optical reflectors having a reflective surface comprising a specular material and the reflector arm having a reflective surface comprising a glossy white finish.

12. The method of claim 8, wherein the electrical sockets are positioned such that the projection areas of the linear lamps received by the electrical sockets are completely nonoverlapping.

13. The method of claim 10, wherein the side optical reflectors have lower surfaces relative to the target area and are configured to eliminate stray light directed at or below a plane under the lower surface of the optical reflector to which the reflector arm is attached.

14. The indirect luminaire assembly of claim 1, wherein the multiple electrical sockets include two pairs of electrical sockets, the electrical sockets of each pair being positioned on opposite ends of the elongate outer housing to receive one of the linear lamps.

* * * * *